United States Patent [19]

Agelakopoulos

[11] Patent Number: 4,757,768

[45] Date of Patent: Jul. 19, 1988

[54] EXTENDABLE SAFETY RAIL FOR LOCOMOTIVES

[76] Inventor: Eftimios C. Agelakopoulos, 5686 Broadview Rd., #002 Bldg., Apt. 2223, Parma, Ohio 44134

[21] Appl. No.: 933,812

[22] Filed: Nov. 24, 1986

[51] Int. Cl.[4] ..... B61C 17/00

[52] U.S. Cl. ..... 105/457; 105/439; 105/461

[58] Field of Search ..... 105/457–460, 105/425, 436, 439, 440, 442, 380, 386, 389, 26.05, 461, 463.1; 280/760, 762, 748; 296/35.2, 1 R; 5/11

[56] References Cited

U.S. PATENT DOCUMENTS

| | | | |
|---|---|---|---|
| 560,238 | 5/1896 | Smith, Jr. | 105/457 |
| 850,585 | 4/1907 | Kendrick | 105/380 |
| 1,056,053 | 3/1913 | Priebe | 105/457 X |
| 1,345,338 | 7/1920 | Baker | 105/457 X |
| 1,428,746 | 9/1922 | Blunt | 105/457 X |
| 1,972,712 | 9/1934 | Lager | 5/11 X |
| 4,169,623 | 10/1979 | Smith | 105/461 X |
| 4,186,665 | 2/1980 | de Jong et al. | 105/457 X |
| 4,240,648 | 12/1980 | Starr | 280/760 |
| 4,427,230 | 1/1984 | Avny | 105/380 X |

FOREIGN PATENT DOCUMENTS

| | | | |
|---|---|---|---|
| 0064583 | 12/1942 | Norway | 5/11 |
| 0002752 | of 1862 | United Kingdom | 105/457 |

*Primary Examiner*—Robert B. Reeves
*Assistant Examiner*—Scott H. Werny

[57] ABSTRACT

An extendable safety rail for locomotives wherein a set of parallel bars is secured horizontally by the ends to vertical posts adaptable for vertical movement inside suitably sized sleeves mounted on the locomotive sides so as to safeguard men working on a locomotive top when the safety rail is in an upward position. When no work is being done the safety rail is lowered onto rubber cushions by the posts sliding into the mating sleeves to insure sufficient underpass clearing when the locomotive is enroute in regular service. The safety rail includes a centrally spaced support rod hinged to a lower horizontal bar for temporarily holding the guard upwards until the ends thereof are secured by appropriate pins at each vertical post, such that one man can extend the guard.

3 Claims, 4 Drawing Sheets

EXTENDABLE SAFETY RAIL FOR LOCOMOTIVES

BACKGROUND OF THE INVENTION

This invention relates to protective devices for locomotive tops subject to secure maintenance in general and to safety rails in particular wherein a set of side guards at each side of a locomotive can be extended to insure safety.

Locomotives with unprotected tops are subject to service of varying types by maintenance workers such as electricians, machinists, pipefitters or biolermakers to name a few, irrespective of surface conditions thereof, be it wet or slippery. Frequently, working conditions on locomotive tops with little space therein are too hazardous to provide proper maintenance by workers.

Conventionally, it has been customary to attach a hand rail directly to the surface of a tank car. Generally this is not applicable to locomotive tops because of size limitation. Any extension above a radiator cooling fan guard would lead to an obstruction for a locomotive clearing an underpass, in particular with diesel-engined electrical locomotives. To prevent disaster in service, new ideas have been advanced by a device of the present invention.

SUMMARY OF THE INVENTION

It is an object of the present invention to provide a safety rail for locomotives of different models and sizes.

It is also an object of the present invention to provide an extendable safety rail for locomotives that can serve as a movable guard to extend during maintenance for improving workers safety and to retract at the end of the work on the top of the locomotive.

Briefly stated, in accordance with one aspect of the present invention, a side guard is provided for use in the locomotive tops and is adaptable to being positioned at each opposite locomotive side substantially adjacent radiator vents. The extendable safety rail includes an elongated guard portion of predetermined length which includes at least a pair of horizontally spaced tubular rails of preferrably square configuration secured in parallel to vertical posts at each opposite guard end so as to slidably move vertically inside appropriate sleeves which are permanently secured to a car-body side of the locomotive. Additionally, a set of pins inside appropriate holes in vertical posts define the height of the rail guard extended, while a set of solid rubber blocks, secured to appropriate brackets, insure protection of the retracted rail guard from vibration and service abuse.

BRIEF DESCRIPTION OF THE DRAWINGS

An embodiment of the invention will now be described by way of example only with reference to the accompanying drawings, in which.

DESCRIPTION OF THE PREFERRED EMBODIMENT

Figure 1:
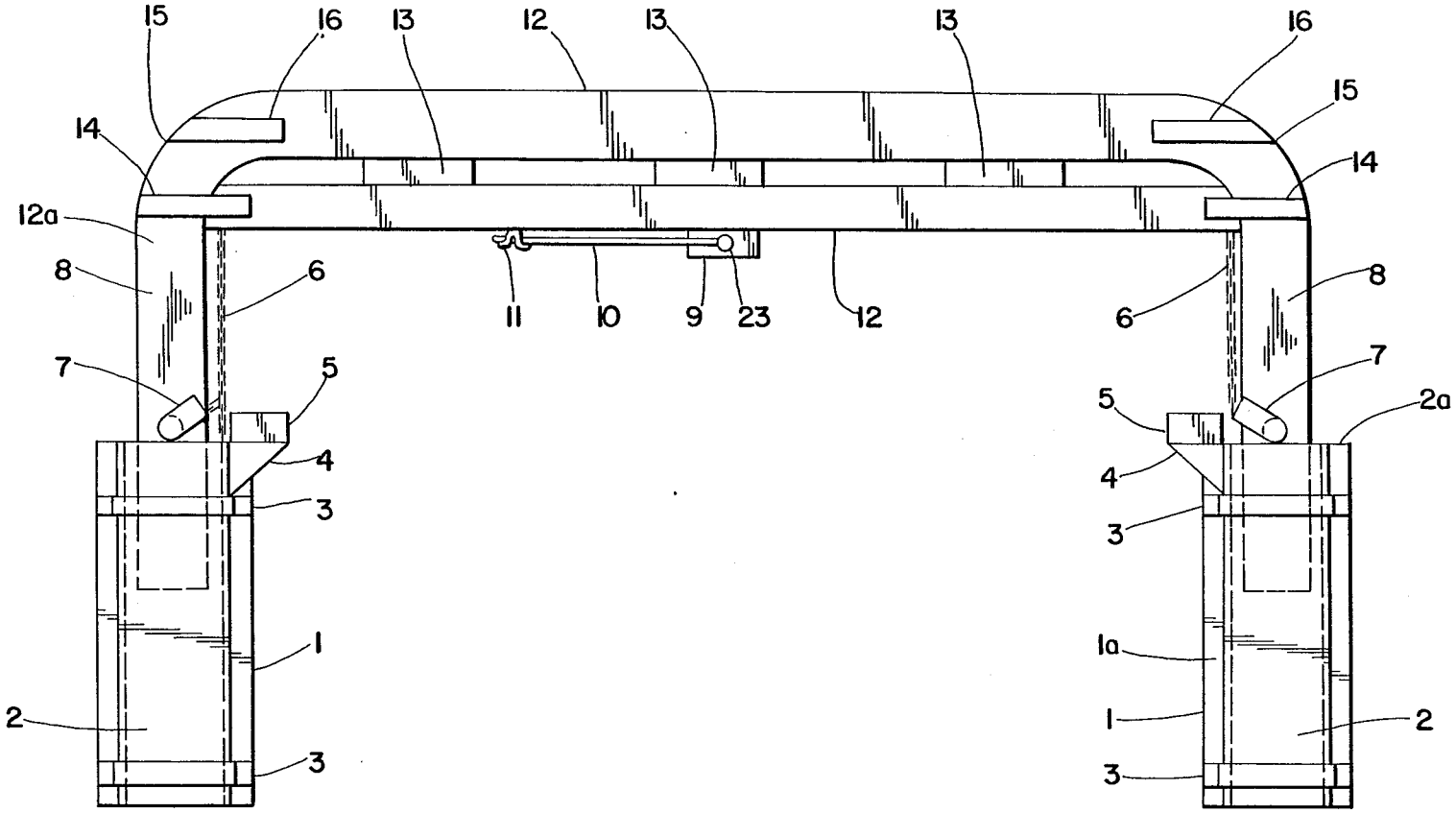
FIG. 1 is a side elevation view of the extendable safety rail guard for locomotives embodying the invention.
Figure 2:
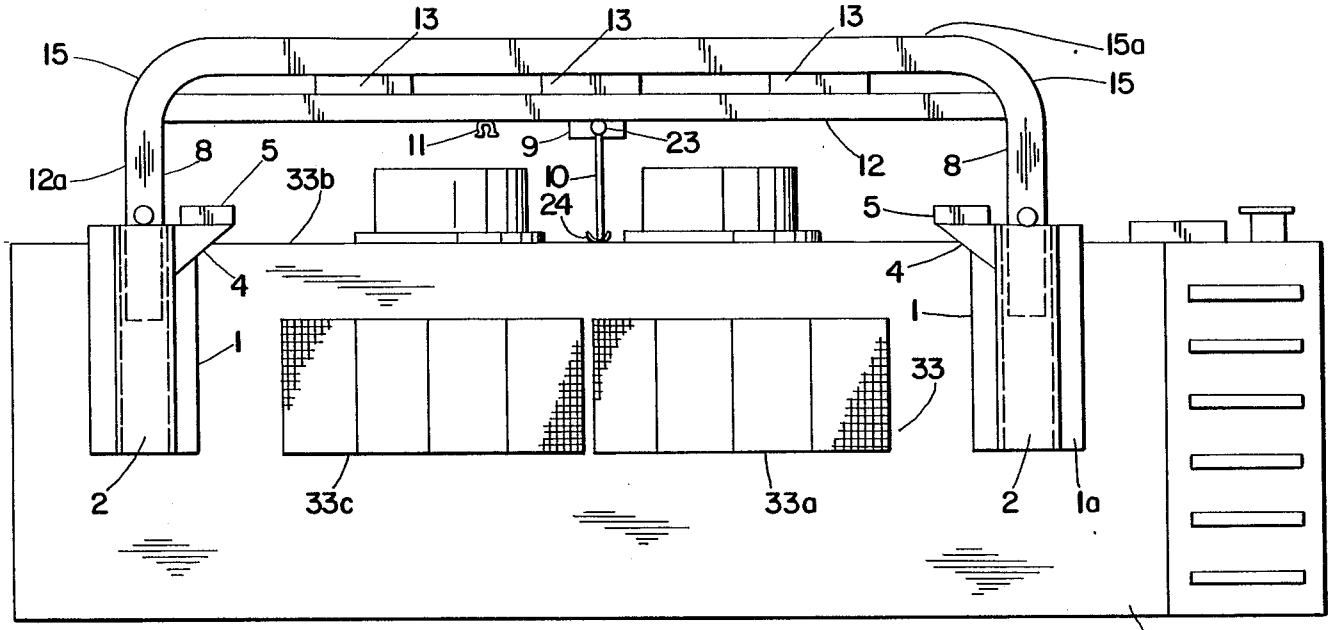
FIG. 2 is a side elevation view of the side guard of FIG. 1 in service when attached to a side of a typical car body of a locomotive with guard extended above the top thereof.

The extendable safety rail guard assembly shown in FIG. 1 has two distinct parts: a movable side guard **12-*a* and a set of stationary sleeve assemblies 1-*a* subject to being permanently attached to a side of the locomotive car body. When such safety rail guard assemblies of FIG. 1 are secured to both sides of the locomotive, they provide physical protection against accidental fall of a serviceman from the top thereof. Conversely, the description of a typical safety rail guard assembly of FIG. 1 applies to the side guards used on both sides of the locomotive top. Turning back to FIG. 1 we find that a stationary sleeve assembly 1-*a* consists of a rectangular plate 1 adaptable for receiving along its length an elongated tubular sleeve 2 which may be welded thereto or secured permanently to plate 1 by straps 3 and provided with a solid rubber block 5 at bracket 4 spaced on top sleeve end 2-*a* for guard protection during a change from the extended position of FIG. 1 to the retracted position of FIG. 5. In FIG. 1 we find two stationary sleeve assemblies 1-*a* at each side of the side guard 12-*a* adaptable for being secured permanently to the side of locomotive car body by welding or similar means. As can be seen from FIG. 1 the movable side guard 12-*a* may be made from elongated tubular rails 12, spaced in parallel and braced by rectangular plates 13 for rigidity, by fabrication using a set of tube elbows 15 including sections 16 at each rail end terminating with a permanently secured vertical post 8, or it may be produced by bending tube 15-*a* per FIG. 2 with posts 8 integral thereto with equal success. The vertical posts 8 of both FIG. 1 and FIG. 2 are made to fit slidably within mating sleeves 2 of sleeve assembly 1-*a* so as to permit an easy movement of guard 12-*a* vertically therein, from a first guard retracted position of FIG. 5 to a second guard extended position of FIG. 1. In turn, this facilitates operation of the guard in the field wherein a single man can either lower or lift the side guard 12-*a* into a desired position alone, particularly when a support rod 10 is used. As shown in FIG. 1 and FIG. 2 the support rod 10 for assistance in guard operation is hinged inside a bracket 9 spaced centrally along the length of lower rail 12. It is either stored sideways inside a clip 11 secured therein a short distance away from bracket 9 of FIG. 1, or lowered down into an appropriate ring 24 on top of the locomotive, as FIG. 2 shows, for supporting the guard, until pins 7 at the ends of chains 6 are placed into the holes of posts 8 to keep the side guard 12-*a* extended. Lowering the side guard 12-*a* is done by reversing the procedure, namely by removing pins 7 first and subsequently by moving support rod 10** sideways into a position shown in FIG. 1. Obviously, the side guard's ultimate function is not dependent on the steps associated with said position change. In the actual side guard application, providing protection on the locomotive top for safe maintenance operation, these steps may be changed with equal success. The extendable safety rail of the present invention provides novel and simple means for worker protection during unassisted maintenance operation on the locomotive top thereby reducing risk to accidents presently unavoidable and often fatal.

FIG. 2 identifies an identical guard shown and described by reference to FIG. 1 when attached to a side of a typical car body 33 of a locomotive for safe working on the top thereof when side guard 12-*a* is extended.

In FIG. 2 the stationary sleeve assemblies 1-*a* are welded to a side 33-*a* of car body 33, substantially flush with the locomotive top 33-*b*, while the sleeves 2 are longitudinally spaced so each is mounted adjacent an end of an elongated air vent 33-*c*. Although the side guard 12-*a* of FIG. 2 is identical to that of FIG. 1, it may be produced by incorporating a single piece external rail 15-*a* which is bent so as to provide integral posts 8 at each side thereof, while the lower rail 12 with bracket 9 plus support rod 10 and clip 11 facing locomotive top 33-*b*, is secured to upper external rail 15-*a* by the ends thereof as well as braces 13 therebetween. Clamps 14 as well as pins 7 with chains 6 of FIG. 1 are omitted from FIG. 2 for clarity only, since their use is unavoidable for guard operation in service.

Figure 3:
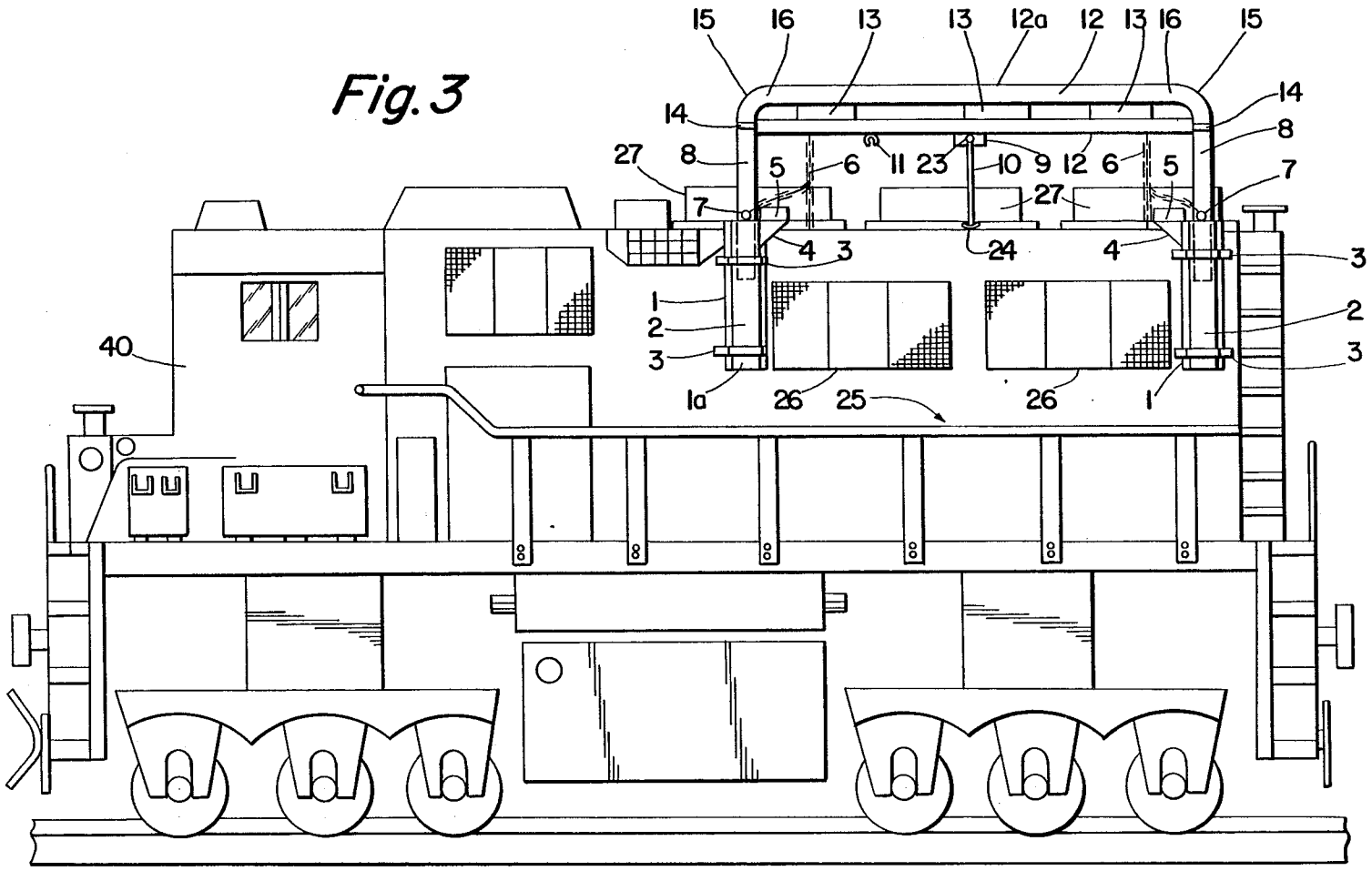
FIG. 3 is a side elevation view of the locomotive provided with the side guard of FIG. 1 with guard extended.

FIG. 3 is a side elevation view of a typical locomotive 40 provided with the side guard 12-*a* of FIG. 1 extended for safety during maintenance operation. In FIG. 3 the stationary sleeve assemblies 1-*a* are positioned along the ends of air vents 26 of the car body 25 so as to secure the locomotive top provided with fan guards 27, subject to maintenance by workers. Like in FIG. 1, the side guard 12-*a* of FIG. 3 is held in the upright position by pins 7 at the end of chain 6 inside holes of vertical posts 8, movable inside sleeves 2, secured to plates 1 by welding or by straps 3. Lowering side guard 12-*a* from the extended position of FIG. 3 requires removal of pins 7 from posts 8 and moving of support rod 10 hinged inside hole 23 of bracket 9 of rail 12 sideways into the clip 11, identical to FIG. 1 and FIG. 2.

Figure 4:
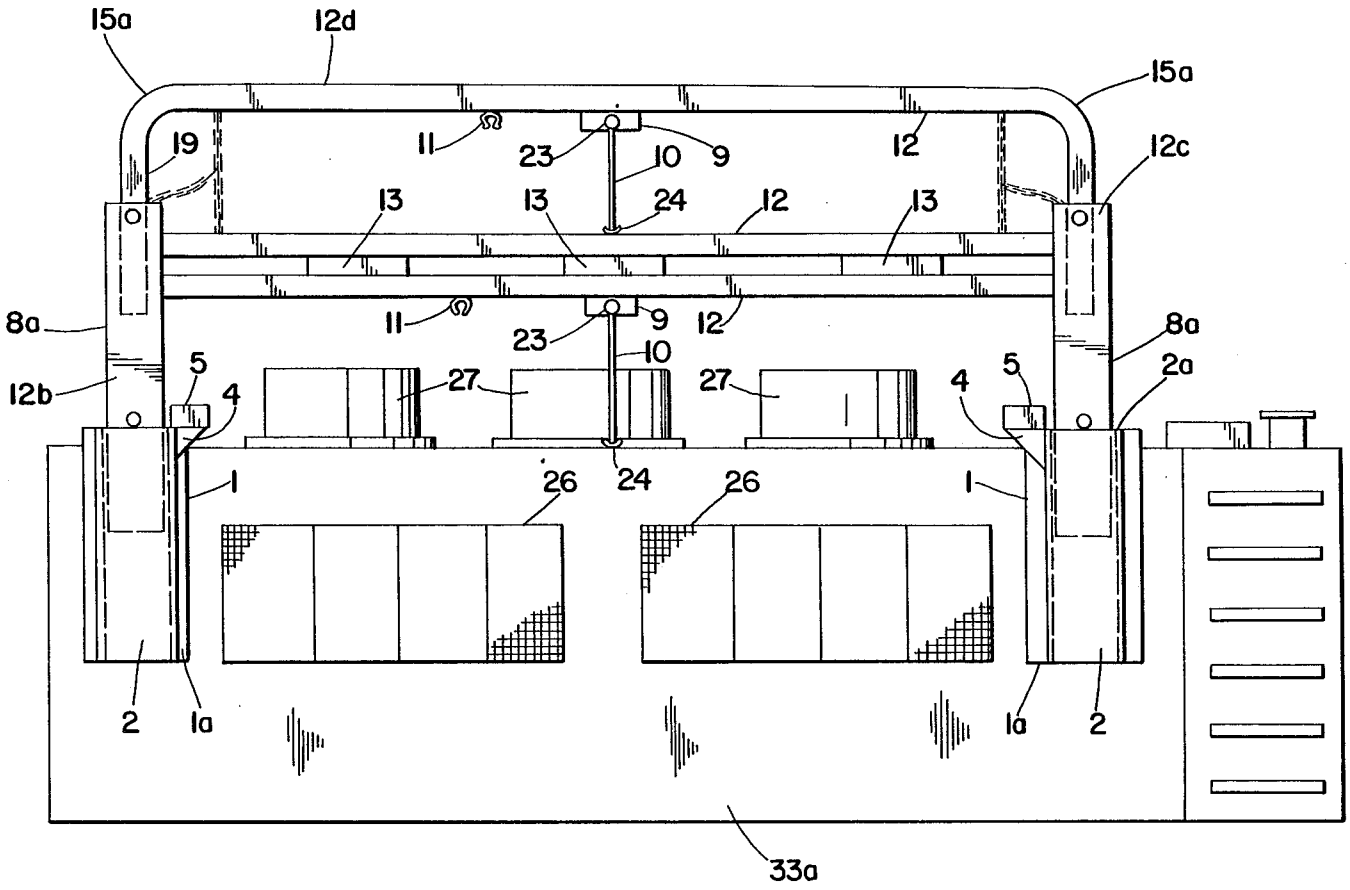
FIG. 4 is a side elevation view of a modified extendable rail guard with telescoping posts for extra height mounted on the side of a car body at the ends of radiator vent openings.

FIG. 4 is a side elevation of a modified extendable rail guard 12-*c* with dual telescoping posts of which post 8-*a* of guard 12-*b* enters sleeve 2 of stationary sleeve assemblies 1-*a* spaced on the side 33-*a* of a carbody 33, at each end of dual air vents 26 and secured thereon by welding with top sleeve end 2-*a* substantially even with locomotive top 33-*b* while the side guard 12-*b* is extended. In case of additional height requirements for better safety, the side guard 12-*b* may be provided with an extra parallel-bar 12-*d* which may be made from tubular rail 15-*a* that is bent at the ends thereof to terminate with posts 19 adaptable for entering open ended tubular posts 8-*a* for securing by pins at the end of chains shown in FIG. 4, including hinged support rod 10 of bracket 9 provided with hole 23.

As can be seen from FIG. 4, the side guard 12-*b* incorporates a set of parallel bars 12 braced by plates 13 and secured by the ends thereof inside the posts 8-*a* in the identical fashion that the side guard of FIG. 1 is constructed. Likewise, side guard 12-*b* contains a centrally spaced support rod 10 hanging from bracket 9, provided with hole 23, so as to enter ring 24 secured to locomotive top 33-*b* for holding the guard in the upright position shown in FIG. 4. Lowering side guard 12-*c* may be done in steps by first lowering bar 12-*d* when pins and support rod 10 are removed, and subsequently lowering guard 12-*b* in identical fashion to rest over the rubber blocks 5 as described by reference to FIG. 1.

Figure 5:
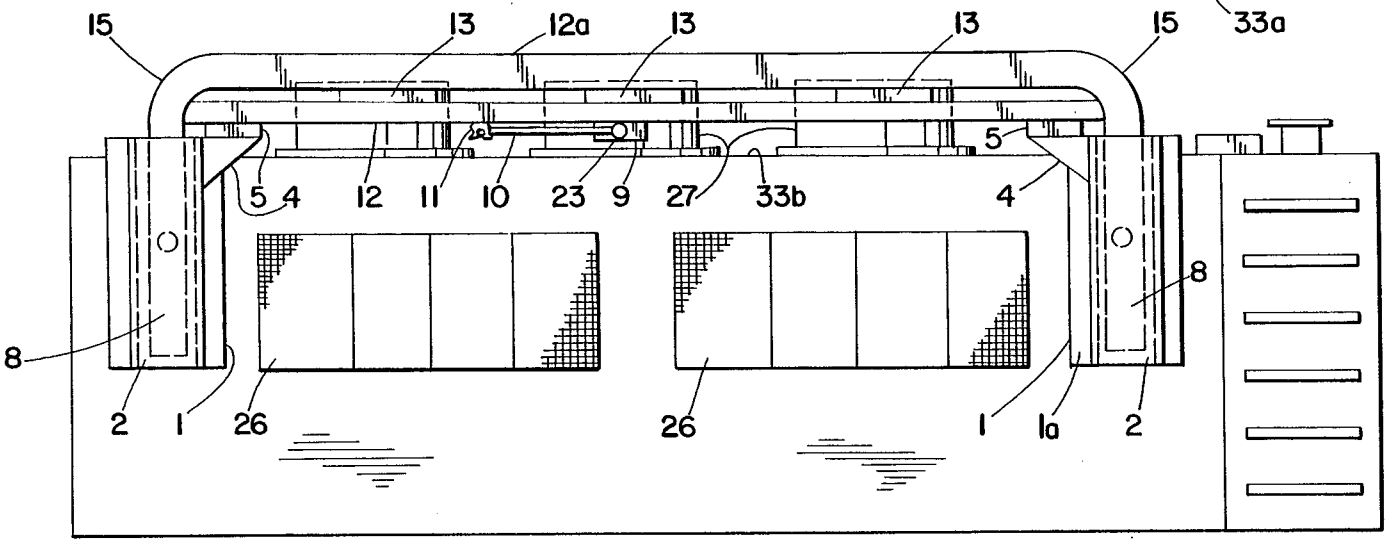
FIG. 5 is a side elevation view of FIG. 1 side guard retracted.

FIG. 5 identifies the side guard of FIG. 1, FIG. 2 and FIG. 3 retracted and resting over rubber block 5 on top of bracket 4 secured to sleeve 2 attached to plate 1 of stationary sleeve assembly 1-*a*, one spaced adjacent each of the ends of dual air vents 26 so as to not exceed the height of fan guards 27 of locomotive top 33-*b*to insure underpass clearing when the locomotive is enroute in regular service.

While particular embodiments of the present invention have been shown and described, it will be apparent to those skilled in the art that various changes and modifications can be made without departing from the spirit of the present invention, and it is intended to cover all these by the following claims.

What is claimed is:

1. A safety rail guard assembly comprising:

an extendable side guard, provided with a set of horizontally spaced tubular bars braced by plates along the length thereof for rigidity, terminating with a set of vertical end posts at each guard end, each post adaptable for vertical movement slidably fitting inside suitably sized sleeves of stationary sleeve assemblies mounted onto locomotive sides, so as to guard men working on a locomotive top from accidents when said side guard is moved from a first, retracted position to a second, extended position, including means for maintaining said positions therein comprising, a hinged support rod spaced along the length of a lower rail of said tubular bars, substantially in the center thereof, inside a bracket provided with a hole, is movable from a first, sideways stored position inside an appropriate clip, parallel to said lower rail, into a second, downward position for support of said side guard when extended, including pins inside appropriate holes of said posts for holding said side guard in said second, extended position until said side guard is lowered into said first, retracted position by removing said pins, followed by removing said support rod thereafter for storing sideways inside said clip, then allowing said side guard to rest over rubber blocks provided thereon.

2. A safety rail guard assembly as in claim 1 wherein said set of horizontally spaced tubular bars includes at least two parallel rails of substantially equal length secured to said vertical end posts, forming said side guard.

3. A safety rail guard assembly comprising:

an extendable side guard with removable sections of which a first section is provided with a set of horizontally spaced tubular rails braced by plates along the length thereof for rigidity, terminating with a set of vertical end posts adaptable for receiving slidably therein, a set of smaller size post ends of a second section of horizontally spaced parallel rails, and together with said first section comprising a telescopingly structured safety rail guard assembly which is adaptable for vertical movement slidably fit inside suitably sized sleeves of stationary sleeve assemblies mounted onto the locomotive sides, so as to guard men working on a locomotive top from accidents by moving said safety rail guard assembly from a first, retracted position to a second, extended position, including means for maintaining said positions therein comprising, a set of hinged support rods of which a first support rod is spaced movably along the length of a lower rail of said first section, substantially in the center thereof inside a bracket provided with a hole, movable from a first, sideways stored position inside an appropriate clip provided thereon, into a second, downward position for support of said side guard when extended, including pins inside appropriate holes of said posts for holding said safety rail guard assembly in said second, extended position while a second, support rod is spaced along the length of said parallel rail substantially in the center thereof inside a bracket provided with a hole movably from a first, sideways, stored position inside an appropriate clip provided therein into a second, downward position for support of said second section when extended, including pins inside appropriate holes of smaller size end posts for holding said second section of said side guard, when said second section is extended, until said side guard is lowered into a first, retracted position by removing said pins, followed by removing said support rod thereafter for storing sideways inside said clip, then allowing said safety rail guard assembly to rest over a set of rubber blocks provided thereon.

* * * * *